US007293687B2

(12) United States Patent
Weil et al.

(10) Patent No.: US 7,293,687 B2
(45) Date of Patent: Nov. 13, 2007

(54) APPARATUS FOR MANUFACTURING TUBES

(75) Inventors: Wolfgang Weil, Müllheim (DE); Walther Lacher, Schliengen (DE)

(73) Assignee: Weil Engineering GmbH, Mullheim (DE)

( * ) Notice: Subject to any disclaimer, the term of this patent is extended or adjusted under 35 U.S.C. 154(b) by 0 days.

(21) Appl. No.: 11/200,602

(22) Filed: Aug. 10, 2005

(65) Prior Publication Data

US 2006/0032889 A1 Feb. 16, 2006

(30) Foreign Application Priority Data

Aug. 14, 2004 (DE) ..... 10 2004 039 577

(51) Int. Cl.
*B23K 37/00* (2006.01)

(52) U.S. Cl. ..... 228/44.3; 228/47.1

(58) Field of Classification Search ..... 228/47.1, 228/44.3

See application file for complete search history.

(56) References Cited

U.S. PATENT DOCUMENTS 557,479 A * 3/1896 Boyd ..... 228/16
635,822 A * 10/1899 Twer ..... 228/16
1,124,764 A * 1/1915 Lloyd ..... 228/26
1,293,486 A * 2/1919 Lloyd ..... 228/26
1,341,840 A * 6/1920 Cave et al. ..... 228/196
1,493,643 A * 5/1924 Pearsall ..... 228/158
1,989,486 A * 1/1935 Matthaei ..... 228/17.5
2,486,494 A * 11/1949 Rice ..... 269/266
3,521,604 A 7/1970 Nickel
4,741,468 A * 5/1988 Weil et al. ..... 228/16
6,382,496 B1 * 5/2002 Harger ..... 228/44.3
6,557,600 B1 * 5/2003 VeNard ..... 144/250.18

FOREIGN PATENT DOCUMENTS

DE 44 32 674 2/1996
GB 1 297 056 11/1972

* cited by examiner

*Primary Examiner*—Jonathan Johnson
*Assistant Examiner*—Rachel E. Beveridge
(74) *Attorney, Agent, or Firm*—Volpe and Koenig P.C.

(57) ABSTRACT

An apparatus (1) for manufacturing tubes made from thin-walled material, especially made from sheet metal, with a welding machine for longitudinal-seam welding, as well as with a clamping device (2), which has clamping jaws, which are arranged on opposite sides of the tube blank (3) and which can be pressed against the tube blank (3) for holding a tubular, preformed blank in the welding position. The clamping jaws (4) each have a stack of pressure plates (5), which contact each other on the flat sides thereof, and which contact the tube blank (3) on the narrow sides thereof in a contact region (6), and which can be pressed against the tube blank (3). The plate stacks are adapted to the outer contours of the tube blank (3) in the contact region (6). Through the use of the apparatus according to the invention, a uniform and uniformly load-bearing weld seam can be achieved, even for contoured tubes, which have outer diameters that vary along the course of their longitudinal extent.

7 Claims, 1 Drawing Sheet

APPARATUS FOR MANUFACTURING TUBES

BACKGROUND

The invention relates to an apparatus for manufacturing tubes made from thin-walled material, especially made from sheet metal, with a welding machine for longitudinal-seam welding and also with a clamping device, which has clamping jaws that are arranged on opposite sides of the tube blank and that can be pressed against the tube blank for holding a tubular, preformed blank in the welding position.

Apparatuses of the above-noted type are already known with a clamping device, whose clamping jaws each consist of a number of clamping elements, which are set at a distance from each other and which can be pressed against the tube blank for holding a tubular, preformed blank in the welding position. Because the gap between the tube blank sides to be welded to each other varies slightly in the region of each clamping element, the weld seam can rarely be produced with the desired accuracy and quality over the entire longitudinal extent, especially for contoured tubes.

Apparatuses with a clamping device that include pressure rollers arranged in pairs on opposite sides of the tube blank have also already been designed. Because the tube blank forms only a tangential contact with these pressure rollers, the pressure rollers can clamp the tube blank between themselves such that the sides of the tube blank to be welded to each other can contact each other uniformly in the welding region and a uniform weld seam is produced. However, such pressure rollers cannot be used in contoured tube blanks, which have outer diameters that vary over the longitudinal extent of the tube.

SUMMARY

Therefore, in particular, the objective arises of providing an apparatus of the above-noted type, with which a uniform weld seam can be achieved even for such contoured tube blanks.

According to the invention, the solution of this objective for the apparatus of the above-noted type is provided in that the clamping jaws each have a stack of pressure plates, which contact each other on their flat sides, and which contact the tube blank on their narrow sides in a contact region, and which can be pressed against the tube section; and in that the plate stacks are adapted in a contact region to the outer contours of the tube blank. The apparatus according to the invention has a clamping device, whose clamping jaws arranged on opposite sides of the tube blank each have a stack of pressure plates which contact each other on their flat sides. These plate stacks are adapted to the outer contours of the tube blank in a contact region, such that the pressure plates contact the tube blank on their narrow sides. The clamping device of the apparatus according to the invention with its plate stacks formed from a plurality of pressure plates guarantees that the sides to be welded to each other, even of a contoured tube blank, contact each other uniformly over the entire longitudinal extent. The tubes manufactured in the apparatus according to the invention thus distinguish themselves by a weld seam that can always be loaded uniformly.

So that the sides of the tube blank to be welded to each other can realize a uniform contact with each other in the region of the welding spot of the welding machine, it is advantageous if the pressure plates each have a plate thickness that corresponds approximately to a width of the tube material softened in point areas by the welding spot of the welding machine.

According to one aspect of the invention, the clamping jaws can each be pressed against the tube blank by at least one pressure roller, wherein these pressure rollers apply force to the pressure plates on their narrow sides facing away from the contact region. The radial and correspondingly large pressure force of the pressure rollers is transferred to the tube blank by the pressed pressure plates of the plate stack.

In order to be able to manufacture large load-bearing pressure plates with low expense, for example, using laser-cut blanks, it is advantageous if the pressure plates are each formed from one sheet metal blank.

The plate stack formed from a plurality of pressure plates can move easily and quickly relative to the tube blank, if the clamping jaws each have a clamping bar, on which the plate stack allocated to this clamping jaw is held.

Here, a preferred embodiment according to the invention provides that the clamping bars of opposing clamping jaws limit the weld seam between themselves.

In order to be able to apply the largest possible pressure force on the tube blank by means of the clamping jaws, it is advantageous if the pressure rollers can each be pressed against the clamping jaws by means of a two-armed toggle lever. A pressure cylinder or a similar pressure applying device is attached to the arm end of the toggle lever facing away from the pressure roller.

BRIEF DESCRIPTION OF THE DRAWINGS

Additional features of the invention emerge from the following description of embodiments according to the invention in connection with the claims, as well as the drawing. The individual features can each be reduced to practice individually or in combination for an embodiment according to the invention.

Shown are.

DETAILED DESCRIPTION OF THE PREFERRED EMBODIMENTS

Figure 2:
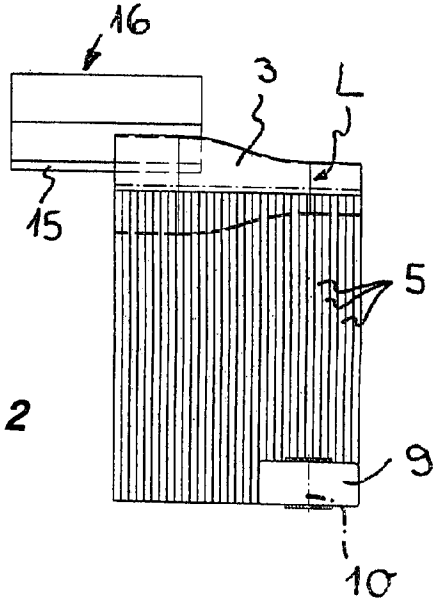
FIG. 2 is a side view of the apparatus of FIG. 1.
Figure 1:
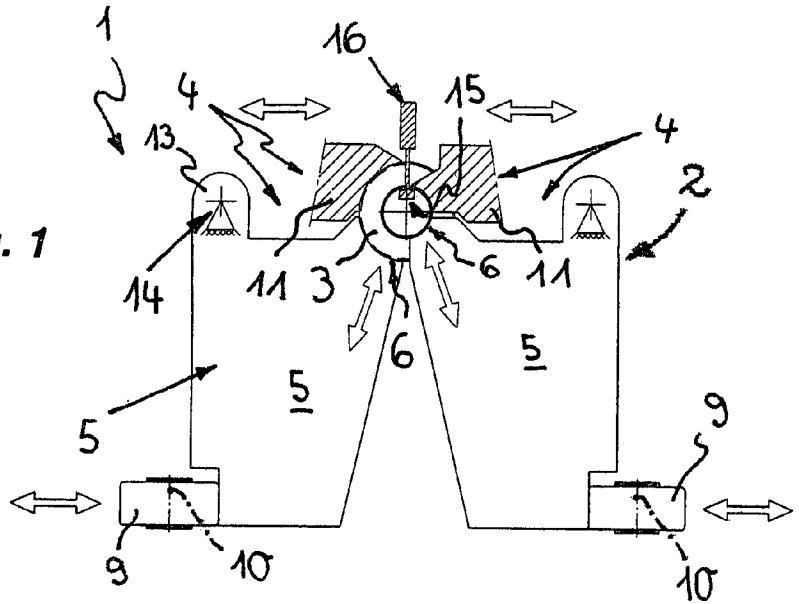
FIG. 1 is a front view of an apparatus for manufacturing tubes made from a thin-walled, preformed tube blank.
Figure 3:
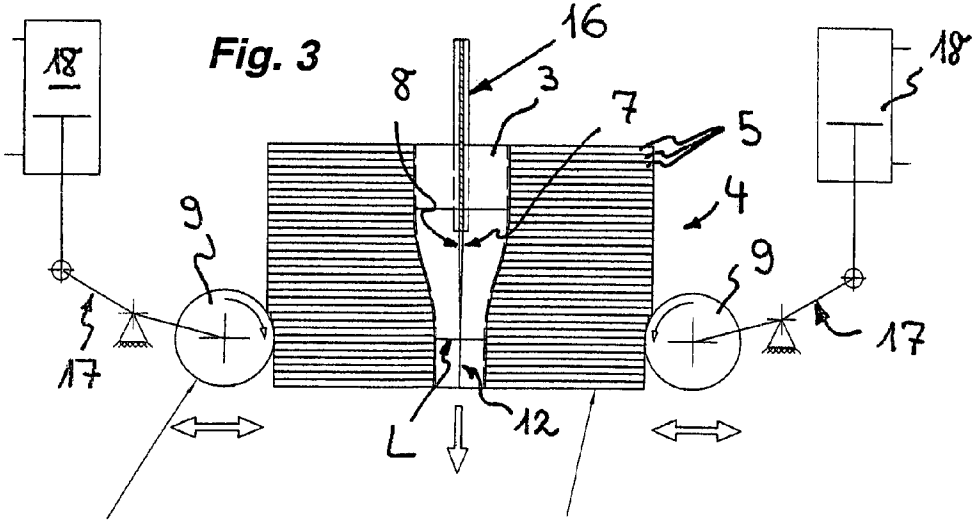
FIG. 3 is a plan view of the apparatus from FIGS. 1 and 2.

In FIGS. 1 to 3, an apparatus 1 for manufacturing tubes made from thin-walled material, especially made from sheet metal, is illustrated in various views.

The apparatus 1 has a butt-seam welding machine not illustrated here in more detail for longitudinal-seam welding, as well as a clamping device 2, which is designed for holding a tubular, preformed material blank 3 in the welding position.

The clamping device 2 has clamping jaws 4, which are arranged on opposite sides of the tube blank 3 and which can be pressed against the tube blank 3. The clamping jaws 4 each have a stack of pressure plates 5, which contact each other on their flat sides and which contact the tube blank 3 on their narrow sides in a contact region 6. As becomes clear from a comparison of FIGS. 1 to 3, the plate stack is adapted in the contact region 6 to contoured outer contours of the tube blank 3, which has an outer diameter that varies over its longitudinal extent.

So that the sides 7, 8 of the tube blank 3 to be welded to each other can move in the direction towards each other and can realize a uniform contact with each other, the clamping jaws 4 can each be pressed against the tube section 3 by a pressure roller 9. The axles 10 of the pressure rollers 9 allocated in pairs with each other on opposite sides of the tube blank 3 are arranged in a plane, which is perpendicular to the longitudinal extent of the tube blank 3 and extends through the welding spot of the welding machine. This plane is indicated in FIGS. 2 and 3 by the line L. Here, the pressure plates 5 receive force from the pressure rollers 9 on their narrow sides facing away from the contact region 6. The pressure rollers 9 thus transfer their radial pressure force to the pressure plates 5 lying in the plane L of the welding spot of the welding machine.

Here, the plate stacks are at times held on solid clamping bars 11 (not illustrated in detail). The clamping bars 11 are allocated in pairs with each other on opposite sides of the tube blank 3 with the longitudinal-seam weld 12 between them.

For this purpose, the pressure plates 5 have a ball joint-like formation 13, with which the pressure plates 5 engage in a complementary socket-shaped recess in the associated clamping bar 11. This connection between the pressure plates 5 forming one plate stack on one side and the associated clamping bar 11 on the other side forms a no-axle hinge 14.

So that the sides 7, 8 of the tube blank to be welded to each other can also be oriented in the radial direction relative to each other, the sides 7, 8 are guided in the T-shaped cross-sectional side edge 15 of a strut 16, which is oriented in the longitudinal direction of the tube and which ends at a distance in front of the welding spot of the welding machine.

From FIG. 3, it becomes clear that the pressure rollers 9 are each supported rotatably on a two-armed toggle lever 17. A pressure cylinder 18 is attached to the arm end of the toggle joint facing away from the pressure roller 9.

The invention claimed is:

1. Apparatus (1) for manufacturing tubes having an outer diameter that varies along a length thereof made from thin-walled material, comprising a welding machine for longitudinal-seam welding, a clamping device (2), which has clamping jaws (4) that are arranged on opposite sides of a tube blank (3) and that can be pressed against the tube blank (3) for holding a tubular, preformed blank (3) in a welding position, the clamping jaws (4) each include a stack of pressure plates (5), which abut each other on flat sides thereof, and which contact the tube blank (3) on narrow sides thereof in a contact region (6), and which can be individually and variably pressed against the tube blank (3) perpendicular to a longitudinal axis (L) of the tube blank; depending on outer contours of the tube blank (3) in the contact region (6).

2. Apparatus according to claim 1, wherein the pressure plates each have a plate thickness, which corresponds approximately to a width of the tube material softened in point areas by a welding spot of the welding machine.

3. Apparatus according to claim 1, wherein the clamping jaws (4) can each be pressed against the tube blank (3) by at least one pressure roller (9), the pressure rollers (9) apply force on the pressure plates (5) on the narrow sides facing away from the contact region (6).

4. Apparatus according to claims 1, wherein the pressure plates (5) are each formed from a sheet-metal blank.

5. Apparatus according to claim 1, wherein the clamping jaws (4) each have a clamping bar (11), on which the stack of pressure plates allocated to the clamping jaw (4) is held.

6. Apparatus according to claim 5, wherein the weld seam (12) is located between the clamping bars (11) of opposing clamping jaws (4).

7. Apparatus according to claim 1, wherein the pressure rollers (9) can each be pressed against the clamping jaws (4) by a two-armed toggle lever (17), with a pressure cylinder (18) or pressure applying device being attached to an arm end of the toggle lever facing away from the pressure roller (9).

* * * * *